US009738294B2

(12) United States Patent
Shubs, Jr. et al.

(10) Patent No.: US 9,738,294 B2
(45) Date of Patent: Aug. 22, 2017

(54) LOCOMOTIVE RIDE-THROUGH CONTROL SYSTEM AND METHOD

(71) Applicant: Electro-Motive Diesel, Inc., Lagrange, IL (US)

(72) Inventors: Alexander Shubs, Jr., Chicago, IL (US); James David Seaton, Westmont, IL (US); David Matthew Roenspies, Elburn, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 14/935,961

(22) Filed: Nov. 9, 2015

(65) Prior Publication Data

US 2017/0129514 A1 May 11, 2017

(51) Int. Cl.

| | |
|---|---|
| ***B61L 27/04*** | (2006.01) |
| ***B61C 5/04*** | (2006.01) |
| ***B61L 25/02*** | (2006.01) |
| ***B61L 23/14*** | (2006.01) |

(52) U.S. Cl.

CPC ..... *B61L 27/04* (2013.01); *B61L 23/14* (2013.01); *B61L 25/025* (2013.01); *B61L 2201/00* (2013.01)

(58) Field of Classification Search

CPC .... B61L 27/04; B61L 27/0016; B61L 23/042; B61L 3/22; B61C 5/04; B60W 10/18

See application file for complete search history.

(56) References Cited

U.S. PATENT DOCUMENTS

| | | | | |
|---|---|---|---|---|
| 3,250,914 A * | 5/1966 | Reich | B61L 3/22 246/122 R |
| 3,334,224 A | 8/1967 | Allen et al. | |
| 8,738,276 B1 | 5/2014 | Boss et al. | |
| 9,002,546 B2 | 4/2015 | Whitmam et al. | |

(Continued)

FOREIGN PATENT DOCUMENTS

WO WO 2015/022118 2/2015

*Primary Examiner* — Yuri Kan

(74) *Attorney, Agent, or Firm* — Finnegan, Henderson, Farabow, Garrett & Dunner, LLP

(57) ABSTRACT

A ride-through control system for operating locomotives in a train includes a geographic position sensor configured to generate a signal indicative of a geographic position of a locomotive of a train, and a controller configured to receive the signal indicative of the geographic position of a locomotive and compare the geographic position of the locomotive with one or more pre-determined geographical locations or regions previously identified as geo-fences. The controller may also be configured to receive one or more locomotive operational signals indicative of at least one of an operational parameter, a fault, and a maintenance request associated with the locomotive, determine whether the geographic position of the locomotive coincides with a geo-fence characterized by conditions that may affect the ability of the locomotive to meet a trip objective if the locomotive were to slow below a threshold speed within the geo-fence, and generate a ride-through control command signal to prevent the locomotive from slowing below the threshold speed within the geo-fence based on at least one of the one or more locomotive operational signals and a user permission level.

19 Claims, 4 Drawing Sheets

(56) References Cited

U.S. PATENT DOCUMENTS

| | | | | |
|---|---|---|---|---|
| 2004/0034556 | A1* | 2/2004 | Matheson | B61L 27/0016 705/7.24 |
| 2010/0042940 | A1 | 2/2010 | Monday et al. | |
| 2011/0283682 | A1* | 11/2011 | Gallagher | B61C 5/04 60/274 |
| 2011/0306304 | A1* | 12/2011 | Forutanpour | G06F 3/04883 455/67.11 |
| 2014/0358376 | A1* | 12/2014 | Phelan | B60W 10/18 701/41 |
| 2015/0009331 | A1* | 1/2015 | Venkatraman | B61L 23/042 348/148 |
| 2015/0120166 | A1* | 4/2015 | Fisher | B61C 17/02 701/101 |
| 2015/0149018 | A1* | 5/2015 | Attard | G05D 1/0061 701/23 |
| 2016/0171787 | A1* | 6/2016 | Yohalashet | G07B 15/063 705/13 |
| 2016/0216130 | A1* | 7/2016 | Abramson | G01C 21/3626 |

* cited by examiner

LOCOMOTIVE RIDE-THROUGH CONTROL SYSTEM AND METHOD

TECHNICAL FIELD

The present disclosure relates generally to a system and method for operating locomotives and, more particularly, to a locomotive ride-through control system and method.

BACKGROUND

Rail vehicles may include multiple powered units, such as locomotives, that are mechanically coupled or linked together in a consist. The consist of powered units operates to provide tractive and/or braking efforts to propel and stop movement of the rail vehicle. The powered units in the consist may change the supplied tractive and/or braking efforts based on a data message that is communicated to the powered units. For example, the supplied tractive and/or braking efforts may be based on Positive Train Control (PTC) instructions or control information for an upcoming trip. The control information may be used by a software application to determine the speed of the rail vehicle for various segments of an upcoming trip of the rail vehicle. Rail systems include areas where stopping the train is a problem. As an example, a particular section of the rail line may have a grade that forces the train to rely on momentum to reach the top of the grade. If the train stops before reaching the top of the grade, the one or more locomotive consists in the train may not have sufficient power or traction to pull the train up the grade from a standing start.

Monitoring systems have been implemented that alert operators and machine controllers of machine operating conditions to allow for improved responses to component failures. These monitoring systems have also been used in conjunction with automatic machine control strategies to improve operational efficiencies and reduce operator responsibilities. Some monitoring systems receive inputs from geographic positioning devices and apply control strategies based on the geographic positions of an associated machine. This type of geographic control strategy is known as geo-fencing.

A geo-fence is a geographic boundary or region that is recognized by monitoring systems and/or control systems when an associated machine crosses the boundary or enters the region. Geo-fences are sometimes used in conjunction with control systems to automatically enable or disable certain control features at certain geographic locations. Some known control systems equipped with geo-fencing features allow operators to establish geo-fence locations and dimensions for implementing certain operational constraints at those locations. However, some machines have numerous operational aspects that are subject to automatic as well as discretionary control. Efficient control of these machines can be difficult for operators to achieve when numerous existing geo-fences require periodic discretionary changes and/or when the establishment of additional geo-fences is desired during an ongoing operation.

A goal in the operation of the locomotives in a train is to eliminate the need for an operator on-board the train. In order to achieve the goal of providing automatic train operation (ATO), a reliable control system must be provided in order to transmit train control commands and other data indicative of operational characteristics associated with various subsystems of the locomotive consists between the train and an off-board, remote controller interface (also sometimes referred to as the "back office"). The control system must be capable of transmitting data messages having the information used to control the tractive and/or braking efforts of the rail vehicle and the operational characteristics of the various consist subsystems while the rail vehicle is moving. The control system must also be able to transmit information regarding a detected fault on-board a locomotive, and respond with control commands to reset the fault. However, if the control system detects a fault, or an early warning of an impending failure, and issues a control command to stop the train in a no-stop zone associated with a steep grade, the train could block the tracks until additional locomotive assets arrive to assist in moving the train over the grade.

A system for managing geo-fence operations of a machine is disclosed in U.S. Patent Application Publication No. 2010/0042940 AI (the '940 publication) of Monday et al., that published on Feb. 18, 2010. In particular, the '940 publication describes a system for adjusting the size, shape, and/or location of a geo-fence via a user interface. The system includes a computer system that receives and displays information via the user interface. The user interface includes an input device and a display. The controller may show a geo-fence to the operator via the display, and the user may change the shape, size, or location of the geo-fence via the input device. The user may also select how close to the geo-fence the machine may travel before a notification is sent to the operator.

While the system of the '940 publication may allow the operator to manipulate certain aspects of geo-fences, other features and aspects of geo-fence control may yet be realized. For example, the '940 publication also does not provide any mechanism that would prevent ATO from stopping the train in a no-stop zone with a steep grade, or performing other automatic control operations that may conflict with preferred control strategies.

The present disclosure is directed at overcoming one or more of the shortcomings set forth above and/or other problems of the prior art.

SUMMARY

In one aspect, the present disclosure is directed to a ride-through control system for operating locomotives in a train. The ride-through control system may include a geographic position sensor configured to generate a signal indicative of the geographic position of a locomotive of a train. The control system may further include a controller configured to receive the signal indicative of the geographic position of a locomotive and compare the geographic position of the locomotive with one or more pre-determined geographical locations or regions previously identified as geo-fences. The controller may be configured to also receive one or more locomotive operational signals indicative of at least one of an operational parameter, a fault, and a maintenance request associated with the locomotive, and to determine whether the geographic position of the locomotive coincides with a geo-fence characterized by conditions that may affect the ability of the locomotive to meet a trip objective if the locomotive were to slow below a threshold speed within the geo-fence. The controller may be still further configured to generate a ride-through control command signal to prevent the locomotive from slowing below the threshold speed within the geo-fence based on at least one of the one or more locomotive operational signals and a user permission level.

In another aspect, the present disclosure is directed to a method of controlling a locomotive. The method may include receiving, at a controller, a position signal transmitted from a geographical position location device, the position signal being indicative of the geographic position of a locomotive of a train. The method may also include comparing the geographic position of the locomotive with one or more pre-determined geographical locations or regions previously identified as geo-fences. The method may further include receiving one or more locomotive operational signals indicative of at least one of an operational parameter, a fault, and a maintenance request associated with the locomotive, and determining whether the geographic position of the locomotive coincides with a geo-fence characterized by conditions that may affect the ability of the locomotive to meet a trip objective if the locomotive were to slow below a threshold speed within the geo-fence. The method may still further include generating a ride-through control command signal to prevent the locomotive from slowing below the threshold speed within the geo-fence based on at least one of the one or more locomotive operational signals and a user permission level.

In yet another aspect, the present disclosure is directed to a non-transitory computer-readable medium for use in controlling ride-through operations on a locomotive, the computer-readable medium comprising computer-executable instructions that, when executed by one or more processors, perform a method including receiving a position signal transmitted from a geographical position location device, the position signal being indicative of the geographic position of the locomotive, and comparing the geographic position of the locomotive with one or more pre-determined geographical locations or regions previously identified as geo-fences. The method may further include receiving one or more locomotive operational signals indicative of at least one of an operational parameter, a fault, and a maintenance request associated with the locomotive, and determining whether the geographic position of the locomotive coincides with a geo-fence characterized by conditions that may affect the ability of the locomotive to meet a trip objective if the locomotive were to slow below a threshold speed within the geo-fence. The method may still further include generating a ride-through control command signal to prevent the locomotive from slowing below the threshold speed within the geo-fence based on at least one of the one or more locomotive operational signals and a user permission level.

DETAILED DESCRIPTION

Figure 1:
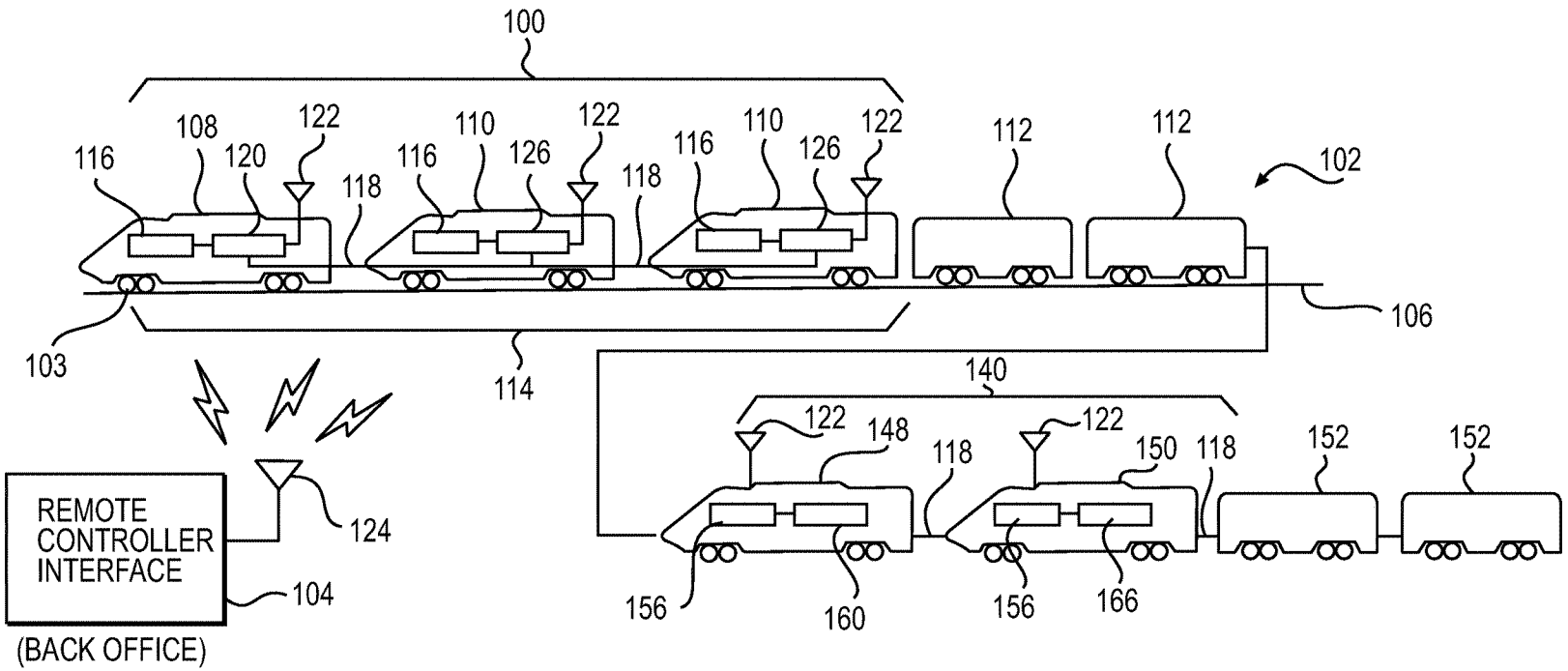
FIG. 1 is a schematic diagram of one embodiment of a control system for a train.

FIG. 1 is a schematic diagram of one embodiment of a control system 100 for operating a train 102 traveling along a track 106. The train may include multiple rail cars (including powered and/or non-powered rail cars or units) linked together as one or more consists or a single rail car (a powered or non-powered rail car or unit). The control system 100 may provide for cost savings, improved safety, increased reliability, operational flexibility, and convenience in the control of the train 102 through communication of network data between an off-board remote controller interface 104 and the train 102. The control system 100 may also provide a means for remote operators or third party operators to communicate with the various locomotives or other powered units of the train 102 from remote interfaces that may include any computing device connected to the Internet or other wide area or local communications network. The control system 100 may be used to convey a variety of network data and command and control signals in the form of messages communicated to the train 102, such as packetized data or information that is communicated in data packets, from the off-board remote controller interface 104. The off-board remote controller interface 104 may also be configured to receive remote alerts and other data from a controller on-board the train, and forward those alerts and data to desired parties via pagers, mobile telephone, email, and online screen alerts. The data communicated between the train 102 and the off-board remote controller interface 104 may include signals indicative of various operational parameters associated with components and subsystems of the train, signals indicative of fault conditions, signals indicative of maintenance activities or procedures, and command and control signals operative to change the state of various circuit breakers, throttles, brake controls, actuators, switches, handles, relays, and other electronically-controllable devices on-board any locomotive or other powered unit of the train 102.

Some control strategies undertaken by the control system 100 may include asset protection provisions, whereby asset operations are automatically derated or otherwise reduced in order to protect train assets, such as a locomotive, from entering an overrun condition and sustaining damage. For example, when the control system detects via sensors that the coolant temperature, oil temperature, crankcase pressure, or another operating parameter associated with a locomotive has exceeded a threshold, the control system may be configured to automatically reduce engine power (e.g., via a throttle control) to allow the locomotive to continue the current mission with a reduced probability of failure. In addition to derating or otherwise reducing certain asset operations based on threshold levels of operational parameters, asset protection may also include reducing or stopping certain operations based on the number, frequency, or timing of maintenance operations or faults detected by various sensors. In some cases, the control system may be configured to fully derate the propulsion systems of the locomotive and/or bring the train 102 to a complete stop to prevent damage to the propulsion systems in response to signals generated by sensors. In this way, the control system may automatically exercise asset protection provisions of its control strategy to reduce incidents of debilitating failure and the costs of associated repairs.

At times, however, external factors may dictate that the train 102 should continue to operate without an automatic reduction in engine power, or without bringing the train to a complete stop. The costs associated with failing to complete a mission on time can outweigh the costs of repairing one or more components, equipment, subsystems, or systems of a locomotive. In one example, a locomotive of the train may be located near or within a geo-fence characterized by a track grade or other track conditions that require the train 102 to maintain a certain speed and momentum in order to avoid excessive wheel slippage on the locomotive, or even stoppage of the train on the grade. Factors such as the track grade, environmental factors, and power generating capabilities of one or more locomotives approaching or entering the pre-determined geo-fence may result in an unacceptable delay if the train were to slow down or stop. In certain situations the train may not even be able to continue forward if enough momentum is lost, resulting in considerable delays and expense while additional locomotives are moved to the area to get the train started again. In some implementations of this disclosure the geo-fences may be characterized as no-stop zones, unfavorable-stop zones, or favorable-stop zones.

In situations when a train is approaching a geo-fence characterized as one of the above-mentioned zones, managers of the train 102 may wish to temporarily modify or disable asset protection provisions associated with automatic control of the locomotive to allow the train 102 to complete its mission on time. However, managers having the responsibility or authority to make operational decisions with such potentially costly implications may be off-board the train 102 or away from a remote controller interface, such as at a back office or other network access point. To avoid unnecessary delays in reaching a decision to temporarily modify or disable asset protection provisions of automatic train operation (ATO), the control system 100 may be configured to facilitate the selection of ride-through control levels via a user interface at an on-board controller or at the off-board remote controller interface 104. The control system 100 may also be configured to generate a ride-through control command signal including information that may be used to direct the locomotive to a geo-fence with a more favorable stop zone The off-board remote controller interface 104 may be connected with an antenna module 124 configured as a wireless transmitter or transceiver to wirelessly transmit data messages to the train 102. The messages may originate elsewhere, such as in a rail-yard back office system, one or more remotely located servers (such as in the "cloud"), a third party server, a computer disposed in a rail-yard tower, and the like, and be communicated to the off-board remote controller interface 104 by wired and/or wireless connections. Alternatively, the off-board remote controller interface 104 may be a satellite that transmits the message down to the train 102 or a cellular tower disposed remote from the train 102 and the track 106. Other devices may be used as the off-board remote controller interface 104 to wirelessly transmit the messages. For example, other wayside equipment, base stations, or back office servers may be used as the off-board remote controller interface 104. By way of example only, the off-board remote controller interface 104 may use one or more of the Transmission Control Protocol (TCP), Internet Protocol (IP), TCP/IP, User Datagram Protocol (UDP), or Internet Control Message Protocol (ICMP) to communicate network data over the Internet with the train 102. As described below, the network data can include information used to automatically and/or remotely control operations of the train 102 or subsystems of the train, and/or reference information stored and used by the train 102 during operation of the train 102. The network data communicated to the off-board remote controller interface 104 from the train 102 may also provide alerts and other operational information that allows for remote monitoring, diagnostics, asset management, and tracking of the state of health of all of the primary power systems and auxiliary subsystems such as HVAC, air brakes, lights, event recorders, and the like.

The train 102 may include a lead consist 114 of powered locomotives, including the interconnected powered units 108 and 110, one or more remote or trailing consists 140 of powered locomotives, including powered units 148, 150, and additional non-powered units 112, 152. "Powered units" refers to rail cars that are capable of self-propulsion, such as locomotives. "Non-powered units" refers to rail cars that are incapable of self-propulsion, but which may otherwise receive electric power for other services. For example, freight cars, passenger cars, and other types of rail cars that do not propel themselves may be "non-powered units", even though the cars may receive electric power for cooling, heating, communications, lighting, and other auxiliary functions.

In the illustrated embodiment of FIG. 1, the powered units 108, 110 represent locomotives joined with each other in the lead consist 114. The lead consist 114 represents a group of two or more locomotives in the train 102 that are mechanically coupled or linked together to travel along a route. The lead consist 114 may be a subset of the train 102 such that the lead consist 114 is included in the train 102 along with additional trailing consists of locomotives, such as trailing consist 140, and additional non-powered units 152, such as freight cars or passenger cars. While the train 102 in FIG. 1 is shown with a lead consist 114, and a trailing consist 140, alternatively the train 102 may include other numbers of locomotive consists joined together or interconnected by one or more intermediate powered or non-powered units that do not form part of the lead and trailing locomotive consists.

The powered units 108, 110 of the lead consist 114 include a lead powered unit 108, such as a lead locomotive, and one or more trailing powered units 110, such as trailing locomotives. As used herein, the terms "lead" and "trailing" are designations of different powered units, and do not necessarily reflect positioning of the powered units 108, 110 in the train 102 or the lead consist 114. For example, a lead powered unit may be disposed between two trailing powered units. Alternatively, the term "lead" may refer to the first powered unit in the train 102, the first powered unit in the lead consist 114, and the first powered unit in the trailing consist 140. The term "trailing" powered units may refer to powered units positioned after a lead powered unit. In another embodiment, the term "lead" refers to a powered unit that is designated for primary control of the lead consist 114 and/or the trailing consist 140, and "trailing" refers to powered units that are under at least partial control of a lead powered unit.

The powered units 108, 110 include a connection at each end of the powered unit 108, 110 to couple propulsion subsystems 116 of the powered units 108, 110 such that the powered units 108, 110 in the lead consist 114 function together as a single tractive unit. The propulsion subsystems 116 may include electric and/or mechanical devices and components, such as diesel engines, electric generators, and traction motors, used to provide tractive effort that propels the powered units 108, 110 and braking effort that slows the powered units 108, 110.

Similar to the lead consist 114, the embodiment shown in FIG. 1 also includes the trailing consist 140, including a lead powered unit 148 and a trailing powered unit 150. The trailing consist 140 may be located at a rear end of the train 102, or at some intermediate point along the train 102. Non-powered units 112 may separate the lead consist 114 from the trailing consist 140, and additional non-powered units 152 may be pulled behind the trailing consist 140.

The propulsion subsystems 116 of the powered units 108, 110 in the lead consist 114 may be connected and communicatively coupled with each other by a network connection 118. In one embodiment, the network connection 118 includes a net port and jumper cable that extends along the train 102 and between the powered units 108, 110. The network connection 118 may be a cable that includes twenty seven pins on each end that is referred to as a multiple unit cable, or MU cable. Alternatively, a different wire, cable, or bus, or other communication medium, may be used as the network connection 118. For example, the network connection 118 may represent an Electrically Controlled Pneumatic Brake line (ECPB), a fiber optic cable, or wireless connection. Similarly, the propulsion subsystems 156 of the powered units 148, 150 in the trailing consist 140 may be connected and communicatively coupled to each other by the network connection 118, such as a MU cable extending between the powered units 148, 150.

The network connection 118 may include several channels over which network data is communicated. Each channel may represent a different pathway for the network data to be communicated. For example, different channels may be associated with different wires or busses of a multi-wire or multi-bus cable. Alternatively, the different channels may represent different frequencies or ranges of frequencies over which the network data is transmitted.

The powered units 108, 110 may include communication units 120, 126 configured to communicate information used in the control operations of various components and subsystems, such as the propulsion subsystems 116 of the powered units 108, 110. The communication unit 120 disposed in the lead powered unit 108 may be referred to as a lead communication unit. The lead communication unit 120 may be the unit that initiates the transmission of data packets forming a message to the off-board, remote controller interface 104. For example, the lead communication unit 120 may transmit a message via a WiFi or cellular modem to the off-board remote controller interface 104. The message may contain information on an operational state of the lead powered unit 108, such as a throttle setting, a brake setting, readiness for dynamic braking, the tripping of a circuit breaker on-board the lead powered unit, or other operational characteristics. Additional operational information associated with a locomotive such as an amount of wheel slippage, wheel temperatures, wheel bearing temperatures, brake temperatures, and dragging equipment detection may also be communicated from sensors on-board a locomotive or other train asset, or from various sensors located in wayside equipment or sleeper ties positioned at intervals along the train track. The communication units 126 may be disposed in different trailing powered units 110 and may be referred to as trailing communication units. Alternatively, one or more of the communication units 120, 126 may be disposed outside of the corresponding powered units 108, 110, such as in a nearby or adjacent non-powered unit 112. Another lead communication unit 160 may be disposed in the lead powered unit 148 of the trailing consist 140. The lead communication unit 160 of the trailing consist 140 may be a unit that receives data packets forming a message transmitted by the off-board, remote controller interface 104. For example, the lead communication unit 160 of the trailing consist 140 may receive a message from the off-board remote controller interface 104 providing operational commands that are based upon the information transmitted to the off-board remote controller interface 104 via the lead communication unit 120 of the lead powered unit 108 of the lead consist 114. A trailing communication unit 166 may be disposed in a trailing powered unit 150 of the trailing consist 140, and interconnected with the lead communication unit 160 via the network connection 118.

Each locomotive or powered unit of the train 102 may include a car body supported at opposing ends by a plurality of trucks. Each truck may be configured to engage the track 106 via a plurality of wheels, and to support a frame of the car body. One or more traction motors may be associated with one or all wheels of a particular truck, and any number of engines and generators may be mounted to the frame within the car body to make up the propulsion subsystems 116, 156 on each of the powered units. The propulsion subsystems 116, 156 of each of the powered units may be further interconnected throughout the train 102 along one or more high voltage power cables in a power sharing arrangement. Energy storage devices (not shown) may also be included for short term or long term storage of energy generated by the propulsion subsystems or by the traction motors when the traction motors are operated in a dynamic braking or generating mode. Energy storage devices may include batteries, ultra-capacitors, flywheels, fluid accumulators, and other energy storage devices with capabilities to store large amounts of energy rapidly for short periods of time, or more slowly for longer periods of time, depending on the needs at any particular time. The DC or AC power provided from the propulsion subsystems 116, 156 or energy storage devices along the power cable may drive AC or DC traction motors to propel the wheels. Each of the traction motors may also be operated in a dynamic braking mode as a generator of electric power that may be provided back to the power cables and/or energy storage devices. Control over engine operation (e.g., starting, stopping, fueling, exhaust aftertreatment, etc.) and traction motor operation, as well as other locomotive controls, may be provided by way of an on-board controller 200 and various operational control devices housed within a cab supported by the frame of the train 102. In some implementations of this disclosure, initiation of these controls may be implemented in the cab of the lead powered unit 108 in the lead consist 114 of the train 102. In other alternative implementations, initiation of operational controls may be implemented off-board at the remote controller interface 104, or at a powered unit of a trailing consist.

Figure 2:
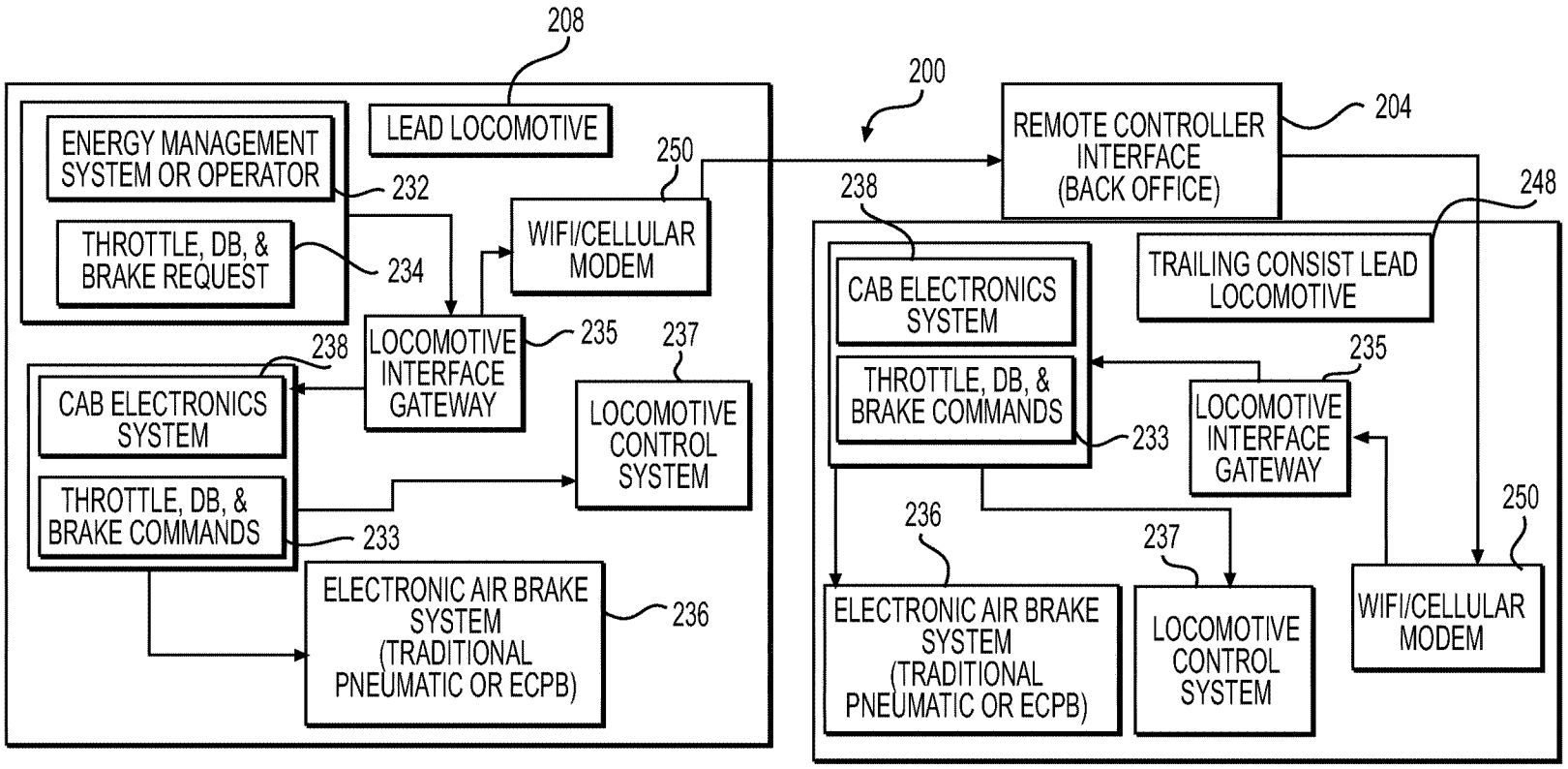
FIG. 2 is a block diagram of one implementation of a portion of the control system illustrated in FIG. 1.

As shown in FIG. 2, an exemplary implementation of the control system 100 may include the on-board controller 200. The on-board controller 200 may include an energy management system 232 configured to determine, e.g., one or more of throttle requests, dynamic braking requests, and pneumatic braking requests 234 for one or more of the powered and non-powered units of the train. The energy management system 232 may be configured to make these various requests based on a variety of measured operational parameters, track grade, track conditions, freight loads, trip plans, and predetermined maps or other stored data with one or more goals of improving availability, safety, timeliness, overall fuel economy and emissions output for individual powered units, consists, or the entire train. The cab of the lead powered unit 108, 148 in each of the consists may also house a plurality of operational control devices and control system interfaces. The operational control devices may be used by an operator to manually control the locomotive, or may be controlled electronically via messages received from off-board the train. Operational control devices may include, among other things, an engine run/isolation switch, a generator field switch, an automatic brake handle, an independent brake handle, a lockout device, and any number of circuit breakers. Manual input devices may include switches, levers, pedals, wheels, knobs, push-pull devices, touch screen displays, etc.

Operation of the engines, generators, inverters, converters, and other auxiliary devices may be at least partially controlled by switches or other operational control devices that may be manually movable between a run or activated state and an isolation or deactivated state by an operator of the train 102. The operational control devices may be additionally or alternatively activated and deactivated by solenoid actuators or other electrical, electromechanical, or electro-hydraulic devices. The off-board remote controller interface 104, 204 may also require compliance with security protocols to ensure that only designated personnel may remotely activate or deactivate components on-board the train from the off-board remote controller interface after certain prerequisite conditions have been met. The off-board remote controller interface may include various security algorithms or other means of comparing an operator authorization input with a predefined security authorization parameter or level. The security algorithms may also establish restrictions or limitations on controls that may be performed based on the location of a locomotive, authorization of an operator, and other parameters.

Circuit breakers may be associated with particular components or subsystems of a locomotive on the train 102, and configured to trip when operating parameters associated with the components or subsystems deviate from expected or predetermined ranges. For example, circuit breakers may be associated with power directed to individual traction motors, HVAC components, and lighting or other electrical components, circuits, or subsystems. When a power draw greater than an expected draw occurs, the associated circuit breaker may trip, or switch from a first state to a second state, to interrupt the corresponding circuit. In some implementations of this disclosure, a circuit breaker may be associated with an on-board control system or communication unit that controls wireless communication with the off-board remote controller interface. After a particular circuit breaker trips, the associated component or subsystem may be disconnected from the main electrical circuit of the locomotive 102 and remain nonfunctional until the corresponding breaker is reset. The circuit breakers may be manually tripped or reset. Alternatively or in addition, the circuit breakers may include actuators or other control devices that can be selectively energized to autonomously or remotely switch the state of the associated circuit breakers in response to a corresponding command received from the off-board remote controller interface 104, 204. In some embodiments, a maintenance signal may be transmitted to the off-board remote controller interface 104, 204 upon switching of a circuit breaker from a first state to a second state, thereby indicating that action such as a reset of the circuit breaker may be needed.

In some situations, train 102 may travel through several different geographic regions and encounter different operating conditions in each region. For example, different regions may be associated with varying track conditions, steeper or flatter grades, speed restrictions, noise restrictions, and/or other such conditions. Some operating conditions in a given geographic region may also change over time as, for example, track rails wear and speed and/or noise restrictions are implemented or changed. Other circumstantial conditions, such as distances between sidings, distances from rail yards, limitations on access to maintenance resources, and other such considerations may vary throughout the course of mission. Operators may therefore wish to implement certain control parameters in certain geographic regions to address particular operating conditions.

To help operators implement desired control strategies based on the geographic location of the train 102, the on-board controller 200 may be configured to include a graphical user interface (GUI) that allows operators and/or other users to establish and define the parameters of geo-fences along a travel route. A geo-fence is a virtual barrier that may be set up in a software program and used in conjunction with global positioning systems (GPS) or radio frequency identification (RFID) to define geographical boundaries. As an example, a geo-fence may be defined along a length of track that has a grade greater than a certain threshold. A first geo-fence may define a no-stop zone, where the track grade is so steep that a train will not be able to traverse the length of track encompassed by the first geo-fence if allowed to stop. A second geo-fence may define an unfavorable-stop zone, where the grade is steep enough that a train stopping in the unfavorable-stop zone may be able to traverse the second geo-fence after a stop, but will miss a trip objective such as arriving at a destination by a certain time. A third geo-fence may define a favorable-stop zone, where the grade of the track is small enough that the train will be able to come to a complete stop within the favorable-stop zone for reasons such as repair or adjustment of various components or subsystems, and then resume travel and traverse the third geo-fence while meeting all trip objectives.

The remote controller interface 104 may include a GUI configured to display information and receive user inputs associated with the train. The GUI may be a graphic display tool including menus (e.g., drop-down menus), modules, buttons, soft keys, toolbars, text boxes, field boxes, windows, and other means to facilitate the conveyance and transfer of information between a user and remote controller interface 104, 204. Access to the GUI may require user authentication, such as, for example, a username, a password, a pin number, an electromagnetic passkey, etc., to display certain information and/or functionalities of the GUI.

The energy management system 232 of the controller 200 on-board a lead locomotive 208 may be configured to automatically determine one or more of throttle requests, dynamic braking requests, and pneumatic braking requests 234 for one or more of the powered and non-powered units of the train. The energy management system 232 may be configured to make these various requests based on a variety of measured operational parameters, track conditions, freight loads, trip plans, and predetermined maps or other stored data with a goal of improving one or more of availability, safety, timeliness, overall fuel economy and emissions output for individual locomotives, consists, or the entire train. Some of the measured operational parameters such as track grade or other track conditions may be associated with one or more predetermined geo-fences. The cab of the lead locomotive 208 in each of the consists 114, 140 along the train 102 may also house a plurality of input devices, operational control devices, and control system interfaces. The input devices may be used by an operator to manually control the locomotive, or the operational control devices may be controlled electronically via messages received from off-board the train. The input devices and operational control devices may include, among other things, an engine run/isolation switch, a generator field switch, an automatic brake handle (for the entire train and locomotives), an independent brake handle (for the locomotive only), a lockout device, and any number of circuit breakers. Manual input devices may include switches, levers, pedals, wheels, knobs, push-pull devices, and touch screen displays. The controller 200 may also include a microprocessor-based locomotive control system 237 having at least one programmable logic controller (PLC), a cab electronics system 238, and an electronic air (pneumatic) brake system 236, all mounted within a cab of the locomotive. The cab electronics system 238 may comprise at least one integrated display computer configured to receive and display data from the outputs of one or more of machine gauges, indicators, sensors, and controls. The cab electronics system 238 may be configured to process and integrate the received data, receive command signals from the off-board remote controller interface 204, and communicate commands such as throttle, dynamic braking, and pneumatic braking commands 233 to the microprocessor-based locomotive control system 237.

The microprocessor-based locomotive control system 237 may be communicatively coupled with the traction motors, engines, generators, braking subsystems, input devices, actuators, circuit breakers, and other devices and hardware used to control operation of various components and subsystems on the locomotive. In various alternative implementations of this disclosure, some operating commands, such as throttle and dynamic braking commands, may be communicated from the cab electronics system 238 to the locomotive control system 237, and other operating commands, such as braking commands, may be communicated from the cab electronics system 238 to a separate electronic air brake system 236. One of ordinary skill in the art will recognize that the various functions performed by the locomotive control system 237 and electronic air brake system 236 may be performed by one or more processing modules or controllers through the use of hardware, software, firmware, or various combinations thereof. Examples of the types of controls that may be performed by the locomotive control system 237 may include radar-based wheel slip control for improved adhesion, automatic engine start stop (AESS) for improved fuel economy, control of the lengths of time at which traction motors are operated at temperatures above a predetermined threshold, control of generators/alternators, control of inverters/converters, the amount of exhaust gas recirculation (EGR) and other exhaust aftertreatment processes performed based on detected levels of certain pollutants, and other controls performed to improve safety, increase overall fuel economy, reduce overall emission levels, and increase longevity and availability of the locomotives. The at least one PLC of the locomotive control system 237 may also be configurable to selectively set predetermined ranges or thresholds for monitoring operating parameters of various subsystems. When a component detects that an operating parameter has deviated from the predetermined range, or has crossed a predetermined threshold, a maintenance signal may be communicated off-board to the remote controller interface 204. The at least one PLC of the locomotive control system 237 may also be configurable to receive one or more command signals indicative of at least one of a throttle command, a dynamic braking readiness command, and an air brake command 233, and output one or more corresponding command control signals configured to at least one of change a throttle position, activate or deactivate dynamic braking, and apply or release a pneumatic brake, respectively.

The cab electronics system 238 may provide integrated computer processing and display capabilities on-board the train 102, and may be communicatively coupled with a plurality of cab gauges, indicators, and sensors, as well as being configured to receive commands from the remote controller interface 204. The cab electronics system 238 may be configured to process outputs from one or more of the gauges, indicators, and sensors, and supply commands to the locomotive control system 237. In various implementations, the remote controller interface 204 may comprise a laptop, hand-held device, or other computing device or server with software, encryption capabilities, and Internet access for communicating with the on-board controller 200 of the lead locomotive 208 of a lead consist and the lead locomotive 248 of a trailing consist. Control command signals generated by the cab electronics system 238 on the lead locomotive 208 of the lead consist may be communicated to the locomotive control system 237 of the lead locomotive of the lead consist, and may be communicated in parallel via a WiFi/cellular modem 250 off-board to the remote controller interface 204. The lead communication unit 120 on-board the lead locomotive of the lead consist may include the WiFi/cellular modem 250 and any other communication equipment required to modulate and transmit the command signals off-board the locomotive and receive command signals on-board the locomotive. As shown in FIG. 2, the remote controller interface 204 may relay commands received from the lead locomotive 208 via another WiFi/cellular modem 250 to another cab electronics system 238 on-board the lead locomotive 248 of the trailing consist.

The control systems and interfaces on-board and off-board the train may embody single or multiple microprocessors, field programmable gate arrays (FPGAs), digital signal processors (DSPs), programmable logic controllers (PLCs), etc., that include means for controlling operations of the train 102 in response to operator requests, built-in constraints, sensed operational parameters, and/or communicated instructions from the remote controller interface 104, 204. Numerous commercially available microprocessors can be configured to perform the functions of these components. Various known circuits may be associated with these components, including power supply circuitry, signal-conditioning circuitry, actuator driver circuitry (i.e., circuitry powering solenoids, motors, or piezo actuators), and communication circuitry.

The locomotives 208, 248 may be outfitted with any number and type of sensors known in the art for generating signals indicative of associated operating parameters. In one example, a locomotive 208, 248 may include a temperature sensor configured to generate a signal indicative of a coolant temperature of an engine on-board the locomotive. Additionally or alternatively, sensors may include brake temperature sensors, exhaust sensors, fuel level sensors, pressure sensors, knock sensors, reductant level or temperature sensors, speed sensors, motion detection sensors, location sensors, or any other sensor known in the art. The signals generated by the sensors may be directed to the cab electronics system 238 for further processing and generation of appropriate commands.

Any number and type of warning devices may also be located on-board each locomotive, including an audible warning device and/or a visual warning device. Warning devices may be used to alert an operator on-board a locomotive of an impending operation, for example startup of the engine(s). Warning devices may be triggered manually from on-board the locomotive (e.g., in response to movement of a component or operational control device to the run state) and/or remotely from off-board the locomotive (e.g., in response to control command signals received from the remote controller interface 204.) When triggered from off-board the locomotive, a corresponding command signal used to initiate operation of the warning device may be communicated to the on-board controller 200 and the cab electronics system 238.

The on-board controller 200 and the off-board remote controller interface 204 may include any means for monitoring, recording, storing, indexing, processing, and/or communicating various operational aspects of the locomotive 208, 248. These means may include components such as, for example, a memory, one or more data storage devices, a central processing unit, or any other components that may be used to run an application. Furthermore, although aspects of the present disclosure may be described generally as being stored in memory, one skilled in the art will appreciate that these aspects can be stored on or read from different types of computer program products or non-transitory computer-readable media such as computer chips and secondary storage devices, including hard disks, floppy disks, optical media, CD-ROM, or other forms of RAM or ROM.

The off-board remote controller interface 204 may be configured to execute instructions stored on non-transitory computer readable medium to perform methods of remote control of the locomotive 230. That is, as will be described in more detail in the following section, on-board control (manual and/or autonomous control) of some operations of the locomotive (e.g., operations of traction motors, engine (s), circuit breakers, etc.) may be selectively overridden by the off-board remote controller interface 204.

Remote control of the various powered and non-powered units on the train 102 through communication between the on-board cab electronics system 238 and the off-board remote controller interface 204 may be facilitated via the various communication units 120, 126, 160, 166 spaced along the train 102. The communication units may include hardware and/or software that enables sending and receiving of data messages between the powered units of the train and the off-board remote controller interfaces. The data messages may be sent and received via a direct data link and/or a wireless communication link, as desired. The direct data link may include an Ethernet connection, a connected area network (CAN), or another data link known in the art. The wireless communications may include satellite, cellular, infrared, and any other type of wireless communications that enable the communication units to exchange information between the off-board remote controller interfaces and the various components and subsystems of the train 102.

As shown in the exemplary embodiment of FIG. 2, the cab electronics system 238 may be configured to receive the requests 234 after they have been processed by a locomotive interface gateway (LIG) 235, which may also enable modulation and communication of the requests through a WiFi/cellular modem 250 to the off-board remote controller interface (back office) 204. The cab electronics system 238 may be configured to communicate commands (e.g., throttle, dynamic braking, and braking commands 233) to the locomotive control system 237 and an electronic air brake system 236 on-board the lead locomotive 208 in order to autonomously control the movements and/or operations of the lead locomotive.

In parallel with communicating commands to the locomotive control system 237 of the lead locomotive 208, the cab electronics system 238 on-board the lead locomotive 208 of the lead consist may also communicate commands to the off-board remote controller interface 204. The commands may be communicated either directly or through the locomotive interface gateway 235, via the WiFi/cellular modem 250, off-board the lead locomotive 208 of the lead consist to the remote controller interface 204. The remote controller interface 204 may then communicate the commands received from the lead locomotive 208 to the trailing consist lead locomotive 248. The commands may be received at the trailing consist lead locomotive 248 via another WiFi/cellular modem 250, and communicated either directly or through another locomotive interface gateway 235 to a cab electronics system 238. The cab electronics system 238 on-board the trailing consist lead locomotive 248 may be configured to communicate the commands received from the lead locomotive 208 of the lead consist to a locomotive control system 237 and an electronic air brake system 236 on-board the trailing consist lead locomotive 248. The commands from the lead locomotive 208 of the lead consist may also be communicated via the network connection 118 from the trailing consist lead locomotive 248 to one or more trailing powered units 150 of the trailing consist 140. The result of configuring all of the lead powered units of the lead and trailing consists to communicate via the off-board remote controller interface 204 is that the lead powered unit of each trailing consist may respond quickly and in close coordination with commands responded to by the lead powered unit of the lead consist. Additionally, each of the powered units in various consists along a long train may quickly and reliably receive commands such as throttle, dynamic braking, and pneumatic braking commands 234 initiated by a lead locomotive in a lead consist regardless of location and conditions.

The integrated cab electronics systems 238 on the powered units of the lead consist 114 and on the powered units of the trailing consist 140 may also be configured to receive and generate commands for configuring or reconfiguring various switches, handles, and other operational control devices on-board each of the powered units of the train as required before the train begins on a journey, or after a failure occurs that requires reconfiguring of all or some of the powered units. Examples of switches and handles that may require configuring or reconfiguring before a journey or after a failure may include an engine run switch, a generator field switch, an automatic brake handle, and an independent brake handle. Remotely controlled actuators on-board the powered units in association with each of the switches and handles may enable remote, autonomous configuring and reconfiguring of each of the devices. For example, before the train begins a journey, or after a critical failure has occurred on one of the lead or trailing powered units, commands may be sent from the off-board remote controller interface 204 to any powered unit in order to automatically reconfigure all of the switches and handles as required on-board each powered unit without requiring an operator to be on-board the train. Following the reconfiguring of all of the various switches and handles on-board each locomotive, the remote controller interface may also send messages to the cab electronics systems on-board each locomotive appropriate for generating other operational commands such as changing throttle settings, activating or deactivating dynamic braking, and applying or releasing pneumatic brakes. This capability saves the time and expense of having to delay the train while sending an operator to each of the powered units on the train to physically switch and reconfigure all of the devices required.

Figure 3:
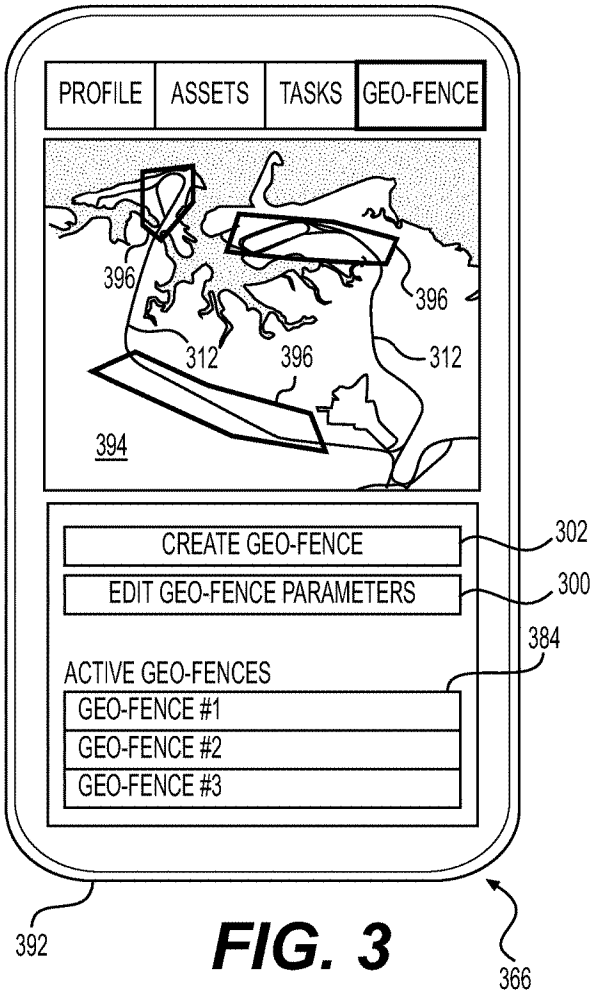
FIG. 3 is a pictorial illustration of an exemplary disclosed graphical user interface (GUI) that may be used in conjunction with the control system illustrated in FIG. 1.

As shown in FIG. 3, the on-board controller 200 and/or off-board remote controller interface 204 may be configured to display on a user interface 366 via a GUI 392 a map 394 of at least a portion of the railroad network. For example, the map 394 may be configured to show sections of tracks 312 in relation to certain geographic features (e.g., regions where the grade of the track exceeds a certain threshold, portions of land, bodies of water, etc.), towns, rail yards, and/or other features. The map 394 may also be indicative of other geographic information, such as topographic data, elevation, and or other information. In some embodiments, the map 394 may show nearby buildings, airports, roadways, waterways, and/or other features, if desired. The on-board controller and/or off-board remote controller interface may be configured to show via the map 394 graphical representations of one or more existing geo-fences 396. Graphical representations of existing geo-fences 396 may be represented by any suitable form of indicia, such as a single line, multiple connected lines, shaded regions, or combinations thereof. In some embodiments, names or other identifying insignia for each existing geo-fence 396 may be shown near each existing geo-fence 396 on the map 394. A list 384 of existing geo-fences 396 may also be displayed on the GUI 392 and include each geo-fence shown on the map 394 at any given moment as well as existing geo-fences 396 not shown on the map 394.

The map 394 may be user-interactive and configured to allow users to manipulate and/or select features of the map 394 by engaging the map via the GUI 392. For example, the map 394 may be movable, expandable, shrinkable, rotatable, etc., in response to the user's selection of associated features, such as scroll bars, scroll buttons, drag-and-drop functionality, and/or other features. Features shown on the map 394, such as existing geo-fences 396, may be selected, for example, by clicking on, touching, or otherwise engaging features as they appear on the map via the GUI 392. Once a feature on the map 394 has been selected, the appearance of the selected feature may indicate that it has been selected, for example, by becoming highlighted, bolded, or otherwise altered in appearance in order to indicate that it has been selected. The list 384 may also be user-interactive and configured to allow users to manipulate and/or select features of the list 384 by engaging the list 384 via the GUI 392. The list 384 may be scrollable (e.g., via scroll buttons, a scroll bar, selectively movable, etc.) to allow the user to browse through any number of existing geo-fences 396 shown or not shown on the map 394. Each existing geo-fence 396 in the list 384 may be selectable by engaging the GUI 392 (e.g., by touching, clicking, etc.). Selections of existing geo-fences 396 in the list 384 may correspond to selections of existing geo-fences 396 shown on the map 394. For example, when a user selects an existing geo-fence 396 via the map 394, the selected geo-fence 396 may become highlighted or otherwise indicate its selection in list 384. Similarly, a selection of an existing geo-fence 396 in the list 384 may cause the selected geo-fence 396 to become highlighted or otherwise indicate its selections on map 394. The GUI 392 may also be configured to receive via various icons or other input devices a user selection of an option to edit an existing geo-fence or an option to create a new geo-fence. For example, pressing an icon for "create geo-fence" 302 may open additional drawing tools or features that allow an operator to define a new geographical region on the map 394 encompassing a length of track where the grade exceeds a certain threshold, or where weather conditions have temporarily resulted in an iced portion of track that may create traction problems. Another icon for "edit geo-fence parameters" 300 may open up tools allowing a user to modify parameters associated with a particular geo-fence, such as characterizing a first geo-fence as a no-stop zone, a second geo-fence as an unfavorable-stop zone, and a third geo-fence as a favorable-stop zone.

Figure 4:
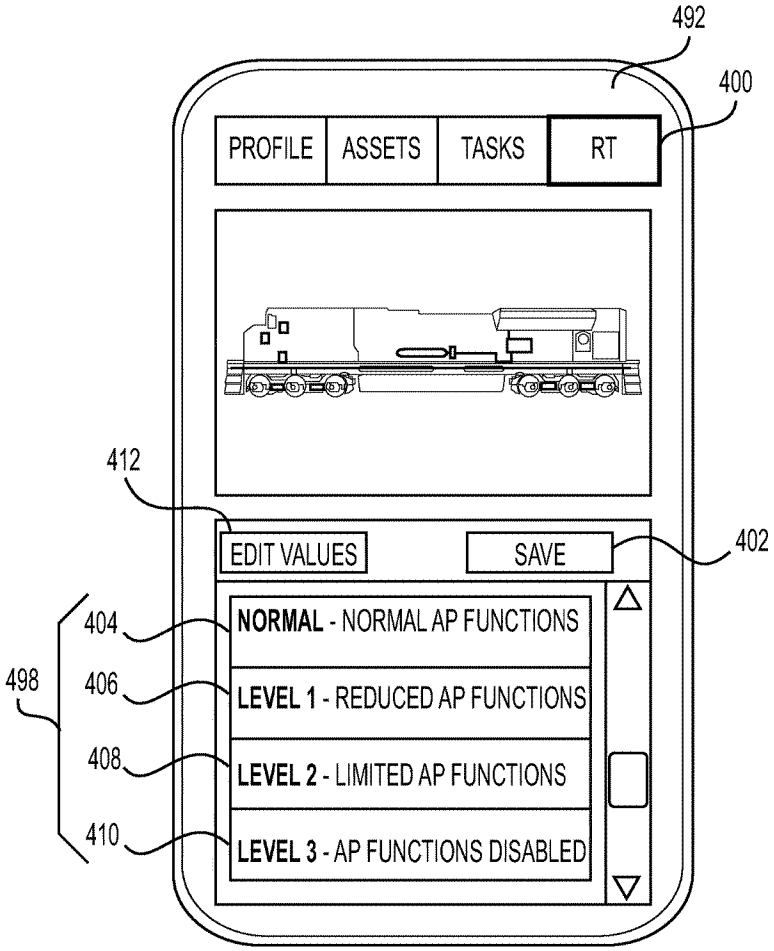
FIG. 4 is another pictorial illustration of an exemplary disclosed graphical user interface (GUI) that may be used in conjunction with the control system illustrated in FIG. 1.

As shown in FIG. 4 a user interface on-board or off-board a locomotive may include a GUI 492 configured to display information and receive user inputs associated with the train 102. The GUI 492 may be a graphic display tool including menus (e.g., drop-down menus), modules, buttons, soft keys, toolbars, text boxes, field boxes, windows, and other means to facilitate the conveyance and transfer of information between a user and remote off-board controller interface 204 and/or on-board controller 200. Access to the features of either controller may require user authentication, such as, for example, a username, a password, a pin number, an electromagnetic passkey, etc., to display certain information and/or functionalities of the GUI 492.

Information displayed by on-board controller 200 or remote controller interface 204 via the GUI 492 may include one or more maintenance messages. Each maintenance message may be based on the signal generated by one of a plurality of sensors and indicative of information associated with a particular locomotive system, subsystem, or component. For example, maintenance messages displayed on the GUI 492 may indicate which train 102, locomotive 208, 248, system, subsystem, or component is at issue, as well as an indication of its operational status (e.g., "satisfactory," "attention," "failed," etc.). Maintenance messages may also be associated with and/or indicative of a fault code activated in conjunction with signals from the sensors. In some embodiments, each maintenance message may also include information associated with tasks, notes, reminders, requests, orders, instructions, and/or other information entered by another user, operator, manager, or technician. Maintenance messages may be listed according to a desired priority scheme, such as by operational status, message date, message type, etc.

On-board controller 200 and/or off-board remote controller interface 204 may be configured to display prognostic information in addition to and/or in conjunction with each maintenance message. Prognostic information may include a chart, table, image, or other type of graphical data display configured to convey information relating to operating parameters of the locomotive or other train asset. In some embodiments, prognostic information may be displayed in response to a user selection of a maintenance message and may include information relating to the selected maintenance message. In other embodiments, the GUI 492 may be configured to allow the user to populate prognostic information with different data by swiping an area of the GUI 492, scrolling a scroll bar, opening a menu, or performing another type of selection operation. Prognostic information may include historic data generated by one or more sensors and may be associated with the generation of the selected maintenance message. Prognostic information may be indicative of trending parameter behavior over a period of time (e.g., the past hour, the past day, week, or month, or the past shift).

Prognostic information and/or maintenance messages may provide the user with information regarding the performance of the train asset from which further decisions may be made. When the user decides to reduce the asset protection functionality of automated train controls to allow the train 102 to continue operations at current performance levels, the user may view ride-through control options via the GUI 492. For example, as shown in FIG. 4, on-board controller 200 and/or off-board remote controller interface 204 may be configured to display on the GUI 492 a plurality of selectable ride-through control levels 498 for overriding automated control functions. Each of the selectable ride-through control levels 498 may result in the generation of a different ride-through control command signal. In some embodiments, ride-through control levels 498 may be accessed by selecting a ride-through menu button 400 on the GUI 492. In other embodiments, ride-through control levels 498 may be accessed via a user selection of a maintenance message or of another feature of the GUI 492.

The on-board controller 200 and/or the off-board remote controller interface 204 may also be configured to generate any of the above described information for display on a mobile electronic device. For example, when the controller is a mobile electronic device, such as a mobile computer, personal digital assistant, cellular phone, tablet, computerized watch, computerized glasses, etc., the GUI 492 may be limited in size as compared to when the user interface is associated with, for example, a personal computer, laptop, work station, etc. To allow users to quickly browse through available information and selection options, the controller may display any of the above described information in conjunction with labeled windows or tabs, scroll bars, swipe-able graphics, or other computer-implemented functionality.

Ride-through control levels 498 may be activated upon selection by the user via the GUI 492. The GUI 492 may also display an edit button 412, and a save button 402 to allow the user to change the selected ride-through control level 498 before confirming the selection prior to activation. Ride-through control levels 498 may include any number of levels, as desired. For example, ride-through control levels 498 may include a normal threshold level 404, a plurality of subsequent ride-through control levels 406, 408 associated with decreased asset protection functionality, and a disabled threshold level 410 associated with the disablement of asset protection functions. Each ride-through control level 498 may be associated with one or more operating parameter thresholds stored within the memory of on-board controller 200, off-board remote controller interface 204, or an associated storage device.

For example, normal threshold level 404 may be associated with one or more standard operating parameter thresholds for a locomotive. That is, when normal threshold level 404 is selected, on-board controller 200 and cab electronics system 238 may be configured to automatically control train operations based on signals from sensors and standard operating parameter thresholds stored within its memory or an associated storage device. When subsequent ride-through control levels 406, 408 are selected, on-board controller 200 may be configured to generate ride-through control command signals that automatically control train operations based on signals from sensors and adjusted operating parameter thresholds (i.e., different from the standard operating parameters associated with the normal threshold level 404). Asset protection functionalities of the control strategy associated with on-board controller 200 and/or off-board remote controller interface 204 may also reference the adjusted operating parameter thresholds associated with subsequent ride-through control levels 406, 408 to allow less restricted operations. When disabled threshold level 410 is selected, the controller may be allowed to disregard the operating parameter thresholds in conjunction with the asset protection functionalities of its imbedded control strategy, thereby allowing unrestricted operations. In an exemplary implementation in accordance with this disclosure, the disabled threshold level 410, in which various asset protection functionalities are ignored or significantly reduced, may be associated with a geo-fence characterized by a no-stop zone where the grade of the track is greater than a predetermined threshold. Although FIG. 4 shows four ride-through control level choices (e.g., "normal," Level 1, Level 2, and Level 3), it is understood that more, fewer, or other levels may be shown.

The thresholds associated with each subsequent ride-through control level 406, 408 may successively permit operating parameters of a locomotive to reach greater or lower threshold values during operation before the controller derates or otherwise limits the operations of the locomotive. A ride-through control level may be selected based on the geo-fence associated with a particular geographical location of the train. For example, a steeper grade associated with a particular geo-fence may dictate a requirement for the train to maintain more momentum in order to successfully travel through the region represented by the geo-fence, and meet trip objectives such as a timely arrival at a destination. Therefore, a geo-fence associated with a geographical region of track having a grade above a certain threshold may correlate with a higher ride-through control level. In some implementations the correlation between a particular geo-fence and the ride-through control level may also depend at least in part on other temporary or long term operational parameters associated with a particular locomotive, such as the fuel levels or power output efficiencies of the propulsion subsystems on the locomotive. In another example, temporary environmental conditions, such as ice on the tracks, in a particular geographical region of a train track may result in a geo-fence being at least temporarily associated with the region and correlated with a higher than normal ride-through control level. In this way, the selection of successive ride-through control levels 498 may permit the train 102 to continue its mission without being inhibited by the asset protection functionalities associated with the controller. Thus, upon a user selection of a ride-through control level 498, or an automatic selection based on a geo-fence associated with the location of the locomotive, the on-board controller 200 or off-board remote controller interface 204 may be configured to automatically generate a machine control signal based on the signals generated by sensors and the respective operating parameter thresholds associated with the selected ride-through control level 498.

Each of the plurality of ride-through control levels 498 may also be selectable in conjunction with a user permission level. For example, the controller may determine which ride-through control levels 498 may be displayed or selectable via the GUI 492 based on a username, a password, a pin number, an electromagnetic passkey, or other credential of the user. For example, the normal threshold level 404 may be generally selectable, while each subsequent ride-through control level 406, 408 may require successively higher permissions, and disabled threshold level 410 may require maximum permissions. By allowing remote access to ride-through control levels 498, users with permission to select ride-through control levels 498 may be able to do so upon short notice, from any computational device connected to the network, and without the assistance of onboard personnel. On-board controller 200 or remote controller interface 204 may also be configured to display via the GUI 492 the edit button 412 or other feature configured to allow users to edit, modify, or adjust details associated with each ride-through control level 498. For example, each subsequent ride-through control level 406, 408 may be associated with an adjustment percent from the standard operating parameter thresholds associated with the normal threshold level 404. That is, the adjusted operating parameters associated with each subsequent ride-through control level 406, 408 may be equal to the operating parameters associated with the normal threshold level 404 shifted (e.g., increased or decreased) by an assigned percentage value.

Figure 5:
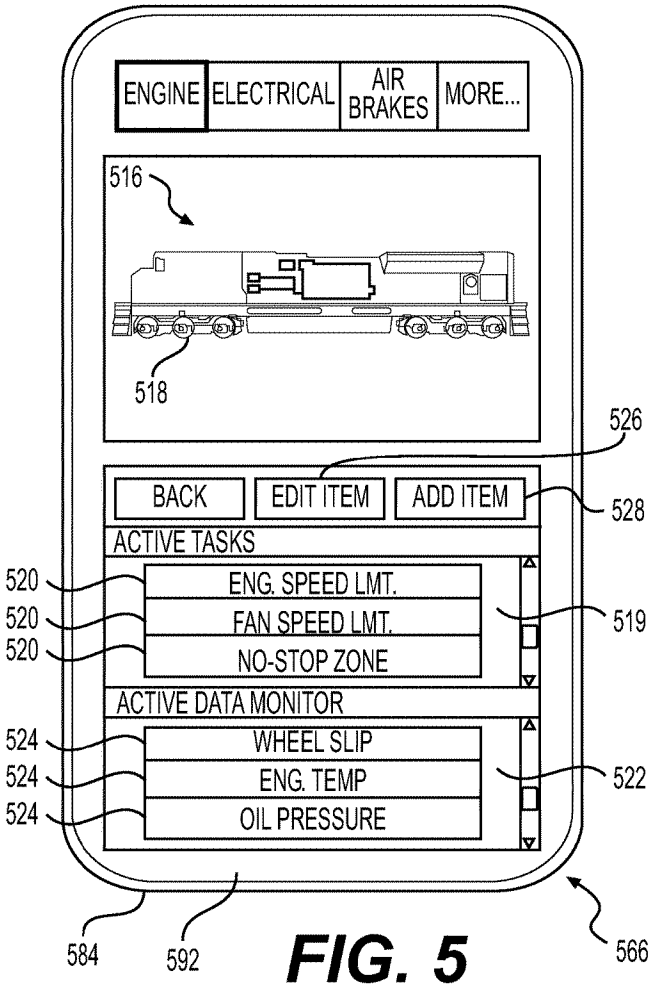
FIG. 5 is another pictorial illustration of an exemplary disclosed graphical user interface (GUI) that may be used in conjunction with the control system illustrated in FIG. 1.

As shown in FIG. 5, the on-board controller 200 and/or off-board remote controller interface 204 may include a user interface 566, which may be part of a hand-held device 584 configured to display via the GUI 592 a list 519 of active tasks 520 and/or a list 522 of active requests to monitor data 524 associated with a new or existing geo-fence. When the user has chosen to edit an existing geo-fence, the list 519 may display active tasks to be carried out by the controller in association with the geo-fence. The list 519 may include active tasks that instruct the controller to, for example, limit the engine speed of the locomotive, limit the fan speed of the locomotive, or prevent the locomotive from slowing below a certain threshold speed or stopping within the geographical area of the geo-fence. Additional or other tasks associated with automatic control of the locomotive may also be included. The list 522 may also include data monitors 524 that represent user requests for the controller to monitor operating parameters of the locomotive within the geo-fence. The operating parameters may include a number of different factors or conditions that may affect the ability of the locomotive to meet a trip objective if the locomotive were to slow below a threshold speed within the geo-fence. Some exemplary factors may include the amount of wheel slip measured at the wheels of a train asset 516 such as a lead locomotive 518, engine temperatures, oil pressures, fuel levels, power efficiency of traction motors, and the like. The lists 519, 522 may be scrollable to allow a user to browse any number of tasks that are active and data monitors that may provide information relevant to determining what ride-through control level should be selected for a particular geo-fence. The GUI 592 may also be configured to receive a user selection of one of a plurality of systems associated with the locomotive 518, such as the engine, the electrical system, the air brakes, etc. The GUI 592 may be configured to populate graphical objects such as active tasks 520 and requests to monitor data 524 with operating parameters and tasks or data monitors based on the selected system.

When the user desires to manually edit an active data monitor 524 or add a new task 520 or data monitor 524 to the lists 519 and 522, respectively, the user may select one of an edit button 526 or an add button 528 displayed on the GUI 592. To edit a task 520 or data monitor 524, the user may select a task 520 or data monitor 524 from the lists 519 or 522, respectively, and then select the edit button 526 to continue. To create a new task 520 or data monitor 524, the user may select the add button 528 to continue. The buttons 526, 528 may be other types of graphical objects, if desired.

Once inputs are received from the user, for example, on the hand-held device 584 at the user interface 566, via the GUI 592, the controller may be configured to generate control command signals in conjunction with a geo-fence at least partially defined by the geographical information, operating parameters, tasks, data monitors, and/or associated operating parameter thresholds. That is, the controller may be configured to control the selected operating parameters according to the selected task and associated operating parameter threshold when the locomotive is within the geographical boundaries of an existing or new geo-fence. Referring back to FIG. 2, control command signals generated by the automatic or manual selection of inputs on the GUI 592 may be received at the on-board controller 200 and modulated via a WiFi cellular modem 250 and locomotive interface gateway (LIG) 235, and provided to the cab electronics system 238 for processing. The cab electronics system 238 may then send, for example, throttle commands and/or dynamic braking commands to the locomotive control system 237, which in turn controls one or more operational control devices to effect the desired changes to the configuration and/or operation of one or more locomotives in the train.

One skilled in the art will realize that the processes illustrated in this description may be implemented in a variety of ways and include other modules, programs, applications, scripts, processes, threads, or code sections that may all functionally interrelate with each other to accomplish the individual tasks described above for each module, script, and daemon. For example, these programs modules may be implemented using commercially available software tools, using custom object-oriented code written in the C++ programming language, using applets written in the Java programming language, or may be implemented with discrete electrical components or as one or more hardwired application specific integrated circuits (ASIC) that are custom designed for this purpose. Other programming languages may be used as desired.

The described implementation may include a particular network configuration, but embodiments of the present disclosure may be implemented in a variety of data communication network environments using software, hardware, or a combination of hardware and software to provide the processing functions.

INDUSTRIAL APPLICABILITY

The control system of the present disclosure may be applicable to any group of locomotives or other powered machines where remote access to particular functions of the machines may be desirable. These functions may normally be controlled manually from on-board each locomotive, and remote access to these functions may provide a way to enable automatic train operation (ATO) when human operators are not present or available at the locomotives. A method of controlling one or more locomotives in accordance with various implementations of this disclosure may include receiving, at a controller, a position signal transmitted from a geographical position location device, the position signal being indicative of the geographic position of a locomotive of a train. The controller may be an on-board controller or an off-board remote controller interface. The method may also include comparing the geographic position of the locomotive with one or more pre-determined geographical locations or regions previously identified as geo-fences. The geo-fences may define lengths of train track along which certain operational constraints are implemented. The method may further include receiving one or more locomotive operational signals indicative of at least one of an operational parameter, a fault, and a maintenance request associated with the locomotive, and determining whether the geographic position of the locomotive coincides with a geo-fence characterized by conditions that may affect the ability of the locomotive to meet a trip objective if the locomotive were to slow below a threshold speed within the geo-fence. The method may still further include generating a ride-through control command signal to prevent the locomotive from slowing below the threshold speed within the geo-fence based on at least one of the one or more locomotive operational signals and a user permission level.

During normal operation, a human operator may be located on-board the lead locomotive 208 and within the cab of the locomotive. The human operator may be able to control when an engine or other subsystem of the train is started or shut down, which traction motors are used to propel the locomotive, what switches, handles, and other input devices are reconfigured, and when and what circuit breakers are reset or tripped. The human operator may also be required to monitor multiple gauges, indicators, sensors, and alerts while making determinations on what controls should be initiated. However, there may be times when the operator is not available to perform these functions, when the operator is not on-board the locomotive 208, and/or when the operator is not sufficiently trained or alert to perform these functions. In addition, the control system 200 in accordance with this disclosure facilitates remote access to and availability of the locomotives in a train for authorized third parties, including providing redundancy and reliability of monitoring and control of the locomotives and subsystems on-board the locomotives.

A method of controlling locomotives in lead and trailing consists of a train in accordance with various aspects of this disclosure may include transmitting an operating control command from a lead locomotive 208 in a lead consist of a train off-board to a remote controller interface 204. The remote controller interface 204 may then relay that operating control command to one or more lead locomotives of one or more trailing consists of the train. In this way, the one or more trailing consists of the train may all respond reliably and in parallel with the same control commands that are being implemented on-board the lead locomotive of the lead consist. As discussed above, on-board controls of the lead locomotive 208 of the lead consist in the train may include the energy management system or human operator 232 providing one or more of throttle, dynamic braking, or braking requests 234 to the cab electronics system 238. The cab electronics system 238 may process and integrate these requests along with other outputs from various gauges and sensors, and commands that may have been received from the off-board remote controller interface 204. The commands received from the off-board remote controller interface 204 may include commands generated manually by a user with the proper permission selecting a particular ride-through control level, or automatically based on a particular geo-fence that a locomotive is entering. The cab electronics system 238, 338 may then communicate commands to the on-board locomotive control system 237, 337. In parallel with these on-board communications, the cab electronics system 238 may communicate the same commands via a WiFi/cellular modem 250, or via a locomotive interface gateway 335 and WiFi/cellular modem 250 to the off-board remote controller interface 204. In various alternative implementations, the off-board remote controller interface 204 may further process the commands received from the lead locomotive 208 of the lead consist in order to modify the commands before transmitting the commands to lead locomotives of trailing consists. Modification of the commands may be based on additional information the remote controller interface has acquired from the lead locomotives of the trailing consists, trip plans, and information from maps or other stored data. The commands may be received from the remote controller interface in parallel at each of the lead locomotives 248 of multiple trailing consists.

In addition to throttle, dynamic braking, and braking commands, the remote controller interface 204 may also communicate other commands to the cab electronics systems of the on-board controllers on one or more lead locomotives in multiple trailing consists. These commands may include switching a component such as a circuit breaker on-board a locomotive from a first state, in which the circuit breaker has not tripped, to a second state, in which the circuit breaker has tripped. The circuit breaker may be tripped in response to detection that an operating parameter of at least one component or subsystem of the locomotive has deviated from a predetermined range. When such a deviation occurs, a maintenance signal may be transmitted from the locomotive to the off-board remote controller interface 204. The maintenance signal may be indicative of a subsystem having deviated from the predetermined range as indicated by a circuit breaker having switched from a first state to a second state. The method may further include selectively receiving a command signal from the remote controller interface 204 at a control device on-board the locomotive, with the command signal causing the control device to autonomously switch the component from the second state back to the first state. In the case of a tripped circuit breaker, the command may result in resetting the circuit breaker.

The method of remotely controlling the locomotives in various consists of a train may also include configuring one or more programmable logic controllers (PLC) of microprocessor-based locomotive control systems 237 on-board one or more lead locomotives to selectively set predetermined ranges for operating parameters associated with various components or subsystems. As discussed above, the predetermined ranges for operating parameters may be selectively set based at least in part on a manually or automatically selected ride-through control level and a geo-fence associated with the location of the locomotive. In one exemplary implementation, a locomotive control system 237 may determine that a circuit of a particular subsystem of the associated locomotive is operating properly when the current flowing through the circuit falls within a particular range. A circuit breaker may be associated with the circuit and configured to trip when the current flowing through the circuit deviates from the determined range. In another exemplary implementation, the locomotive control system may determine that a particular flow rate of exhaust gas recirculation (EGR), or flow rate of a reductant used in exhaust gas aftertreatment, is required in order to meet particular fuel economy and/or emission levels. A valve and/or pump regulating the flow rate of exhaust gas recirculation and/or reductant may be controlled by the locomotive control system when a level of a particular pollutant deviates from a predetermined range. The predetermined ranges for various operating parameters may vary from one locomotive to another based on specific characteristics associated with each locomotive, including age, model, location, weather conditions, type of propulsion system, fuel efficiency, type of fuel, and the like.

The method of controlling locomotives in a train in accordance with various implementations of this disclosure may still further include the cab electronics system 238 on-board a locomotive receiving and processing data outputs from one or more of gauges, indicators, sensors, and controls on-board the locomotive. The cab electronics system 238 may also receive and process, e.g., throttle, dynamic braking, and pneumatic braking requests from the energy management system and/or human operator 232 on-board the locomotive, and command signals from the off-board remote controller interface 204. The command signals received from off-board the locomotive, or generated on-board the locomotive may be determined at least in part by a selected ride-through control level and the particular geo-fence associated with the current location of the train. The cab electronics system 238 may then communicate appropriate commands to the locomotive control system 237 and/or electronic air brake system 236 based on the requests, data outputs and command signals. The locomotive control system 237 may perform various control operations such as resetting circuit breakers, adjusting throttle settings, activating dynamic braking, and activating pneumatic braking in accordance with the commands received from the cab electronics system 238. As discussed above, the control operations may be automatically or manually modified, or even overridden based on the geo-fence and ride-through control levels.

It will be apparent to those skilled in the art that various modifications and variations can be made to the control system and method of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A ride-through control system for operating locomotives in a train, the ride-through control system comprising:

a geographic position sensor configured to generate a signal indicative of a geographic position of a locomotive of a train; and a controller configured to:

receive the signal indicative of the geographic position of a locomotive;

compare the geographic position of the locomotive with one or more pre-determined geographical locations or regions previously identified as geo-fences;

receive one or more locomotive operational signals indicative of at least one of an operational parameter, a fault, and a maintenance request associated with the locomotive;

determine whether the geographic position of the locomotive coincides with a geo-fence characterized by conditions that may affect an ability of the locomotive to meet a trip objective if the locomotive were to slow below a threshold speed within the geo-fence; and generate a ride-through control command signal to prevent the locomotive from slowing below the threshold speed within the geo-fence based on at least one of the one or more locomotive operational signals and a user permission level, wherein the ride-through control command signal is generated by one of an automatic or a manual selection of one of a plurality of ride-through control levels on a GUI associated with the controller, and wherein the controller is further configured to generate the ride-through control command signal to include information that may be used to direct the locomotive to a geo-fence with a more favorable stop zone.

2. The control system of claim 1, wherein the geo-fence is characterized by a train track grade in excess of a predetermined threshold value.

3. The control system of claim 1, wherein the geo-fence is one of a plurality of geo-fences including a first geo-fence associated with a length of track characterized as a no-stop zone, a second geo-fence associated with a length of track characterized as an unfavorable-stop zone, and a third geo-fence associated with a length of track characterized as a favorable-stop zone.

4. The control system of claim 1, wherein the plurality of ride-through control levels include a ride-through control level associated with a normal threshold level of asset protection, a ride-through control level associated with decreased asset protection functionality, and a ride-through control level associated with a disablement of asset protection.

5. The control system of claim 4, wherein asset protection may include one or more of derating or otherwise reducing certain asset operations based on threshold levels of operational parameters, and one of reducing or stopping certain operations based on or more of the number, frequency, or timing of maintenance operations or faults detected by various sensors.

6. The control system of claim 4, wherein the GUI is configured to allow for editing and saving of at least one of the plurality of ride-through control levels and at least one of the plurality of geo-fences.

7. The control system of claim 1, further including:

a cab electronics system comprising at least one integrated display computer configured to:

receive and display data from outputs of one or more of machine gauges, indicators, sensors, and controls;

process and integrate the received data;

receive one or more control command signals from an off-board remote controller interface, wherein the one or more control command signals include the ride-through control command signal; and communicate commands based on the data and the received one or more control command signals; and a locomotive control system, wherein the locomotive control system is configured to receive commands communicated from the cab electronics system and control operation of at least one operational control device on-board the locomotive.

8. The control system of claim 7, wherein the locomotive control system is configured to control one or more of circuit breakers, throttle settings, dynamic braking, and pneumatic braking on an associated locomotive in accordance with the commands received from the cab electronics system.

9. A method of controlling a locomotive, the method comprising:

receiving, at a controller, a position signal transmitted from a geographic position sensor, the position signal being indicative of the geographic position of a locomotive of a train;

comparing with the controller the geographic position of the locomotive with one or more pre-determined geographical locations or regions previously identified as geo-fences;

receiving at the controller one or more locomotive operational signals indicative of at least one of an operational parameter, a fault, and a maintenance request associated with the locomotive;

determining with the controller whether the geographic position of the locomotive coincides with a geo-fence characterized by conditions that may affect the ability of the locomotive to meet a trip objective if the locomotive were to slow below a threshold speed within the geo-fence;

generating a ride-through control command signal to prevent the locomotive from slowing below the threshold speed within the geo-fence based on at least one of the one or more locomotive operational signals and a user permission level;

generating the ride-through control command signal by one of an automatic or a manual selection of one of a plurality of ride-through control levels on a GUI associated with the controller; and generating the ride-through control command signal to include information that may be used to direct the locomotive to a geo-fence with a more favorable stop zone.

10. The method of claim 9, wherein the geo-fence is characterized by a train track grade in excess of a predetermined threshold value.

11. The method of claim 9, wherein the geo-fence is one of a plurality of geo-fences including a first geo-fence associated with a length of track characterized as a no-stop zone, a second geo-fence associated with a length of track characterized as an unfavorable-stop zone, and a third geo-fence associated with a length of track characterized as a favorable-stop zone.

12. The method of claim 9, further including:

selecting one of the plurality of ride-through control levels from a ride-through control level associated with a normal threshold level of asset protection, a ride-through control level associated with decreased asset protection functionality, and a ride-through control level associated with a disablement of asset protection.

13. The method of claim 12, wherein asset protection may include one or more of:

derating or otherwise reducing certain asset operations based on threshold levels of operational parameters; and one of reducing or stopping certain operations based on one or more of the number, frequency, or timing of maintenance operations or faults detected by various sensors.

14. The method of claim 12, wherein selecting one of the plurality of ride-through control levels includes editing and saving of at least one of the plurality of ride-through control levels and at least one of the plurality of geo-fences on the GUI associated with the controller.

15. The method of claim 9, wherein the controller includes a cab electronics system comprising at least one integrated display computer and a locomotive control system, the method further including:

receiving and displaying data from outputs of one or more of machine gauges, indicators, sensors, and controls at the cab electronics system;

processing and integrating the received data;

receiving one or more control command signals from an off-board remote controller interface, wherein the one or more control command signals include the ride-through control command signal;

communicating commands based on the data and the received one or more control command signals; and receiving commands communicated from the cab electronics system at the locomotive control system and controlling operation of at least one operational control device on-board the locomotive, including controlling one or more of circuit breakers, throttle settings, dynamic braking, and pneumatic braking on the locomotive in accordance with the commands received from the cab electronics system.

16. A non-transitory computer-readable medium for use in controlling ride-through operations on a locomotive, the computer-readable medium comprising computer-executable instructions that, when executed by one or more processors, perform a method comprising:

receiving at a controller a position signal transmitted from a geographic position sensor, the position signal being indicative of the geographic position of the locomotive;

comparing with the controller the geographic position of the locomotive with one or more pre-determined geographical locations or regions previously identified as geo-fences;

receiving at the controller one or more locomotive operational signals indicative of at least one of an operational parameter, a fault, and a maintenance request associated with the locomotive;

determining with the controller whether the geographic position of the locomotive coincides with a geo-fence characterized by conditions that may affect the ability of the locomotive to meet a trip objective if the locomotive were to slow below a threshold speed within the geo-fence;

generating a ride-through control command signal to prevent the locomotive from slowing below the threshold speed within the geo-fence based on at least one of the one or more locomotive operational signals and a user permission level;

generating the ride-through control command signal by one of an automatic or a manual selection of one of a plurality of ride-through control levels on a GUI associated with the controller;

generating the ride-through control command signal to include information that may be used to direct the locomotive to a geo-fence with a more favorable stop zone; and selecting one of the plurality of ride-through control levels from a ride-through control level associated with a normal threshold level of asset protection, a ride-through control level associated with decreased asset protection functionality, and a ride-through control level associated with the disablement of asset protection.

17. The non-transitory computer-readable medium of claim 16, further including computer-executable instructions that, when executed by one or more processors, perform a method comprising:

identifying the one or more predetermined geographical locations or regions as a plurality of geo-fences that are each characterized by a grade of train track contained within the geo-fence; and wherein the plurality of geo-fences include a first geo-fence associated with a length of track characterized as a no-stop zone, a second geo-fence associated with a length of track characterized as an unfavorable-stop zone, and a third geo-fence associated with a length of track characterized as a favorable-stop zone.

18. The control system of claim 7, wherein the at least one operational control device is comprised of at least one of engine run/isolation switch, a generator switch, an automatic brake handle, an independent brake handle, a lockout device, and at least one circuit breaker.

19. The method of claim 15, wherein the at least one operational control device is comprised of at least one of engine run/isolation switch, a generator switch, an automatic brake handle, an independent brake handle, a lockout device, and at least one circuit breaker.

* * * * *